US009755308B2

(12) United States Patent
Liou et al.

(10) Patent No.: US 9,755,308 B2
(45) Date of Patent: Sep. 5, 2017

(54) ANTENNA STRUCTURE AND WIRELESS COMMUNICATION DEVICE EMPLOYING SAME

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 157 days.

(21) Appl. No.: 14/508,261

(22) Filed: Oct. 7, 2014

(65) Prior Publication Data

US 2015/0097753 A1 Apr. 9, 2015

(30) Foreign Application Priority Data

Oct. 9, 2013 (CN) ..... 2013 1 0466065

(51) Int. Cl.

| | |
|---|---|
| ***H01Q 21/00*** | (2006.01) |
| ***H01Q 7/00*** | (2006.01) |
| ***H01Q 5/40*** | (2015.01) |
| *H01Q 1/50* | (2006.01) |

(52) U.S. Cl.

CPC ..... *H01Q 7/00* (2013.01); *H01Q 5/40* (2015.01); *H01Q 1/50* (2013.01); *H01Q 21/00* (2013.01)

(58) Field of Classification Search

USPC ..... 343/700 MS, 702, 867, 795

See application file for complete search history.

(56) References Cited

U.S. PATENT DOCUMENTS

| | | | | |
|---|---|---|---|---|
| 2008/0180333 | A1* | 7/2008 | Martiskainen | H01Q 1/243 343/722 |
| 2009/0273530 | A1* | 11/2009 | Chi | H01Q 1/243 343/741 |
| 2011/0063180 | A1* | 3/2011 | Su | H01Q 3/24 343/795 |
| 2012/0218151 | A1* | 8/2012 | Wong | H01Q 1/243 343/700 MS |

* cited by examiner

*Primary Examiner* — Jessica Han
*Assistant Examiner* — Hai Tran
(74) *Attorney, Agent, or Firm* — Steven Reiss

(57) ABSTRACT

An antenna structure includes a feeding portion, a first grounding portion, a second grounding portion, a first loop antenna and a second loop antenna. The feeding portion has a first side and a second side parallel to the first side. The first grounding portion is positioned adjacent and apart from the first side of the feeding portion. The second grounding portion is positioned adjacent and apart from the second side of the grounding portion. The first loop antenna is defined to accept a second loop antenna therein, and is electronically coupled to the first and second grounding portions. The second loop antenna is positioned inside and apart from the first loop antenna, and further electronically coupled to the feeding portion.

18 Claims, 5 Drawing Sheets

ANTENNA STRUCTURE AND WIRELESS COMMUNICATION DEVICE EMPLOYING SAME

FIELD

The subject matter herein generally relates to antenna structures, and particular to a multiband antenna structure and wireless communication device employing same.

BACKGROUND

With improvements in the integration of wireless communication systems, antennas have become increasingly important. For a wireless communication device to utilize various frequency bandwidths, antennas having wider bandwidths have become a significant technology.

BRIEF DESCRIPTION OF THE DRAWINGS

Implementations of the present technology will now be described, by way of example only, with reference to the attached figures.

DETAILED DESCRIPTION

Figure 1:
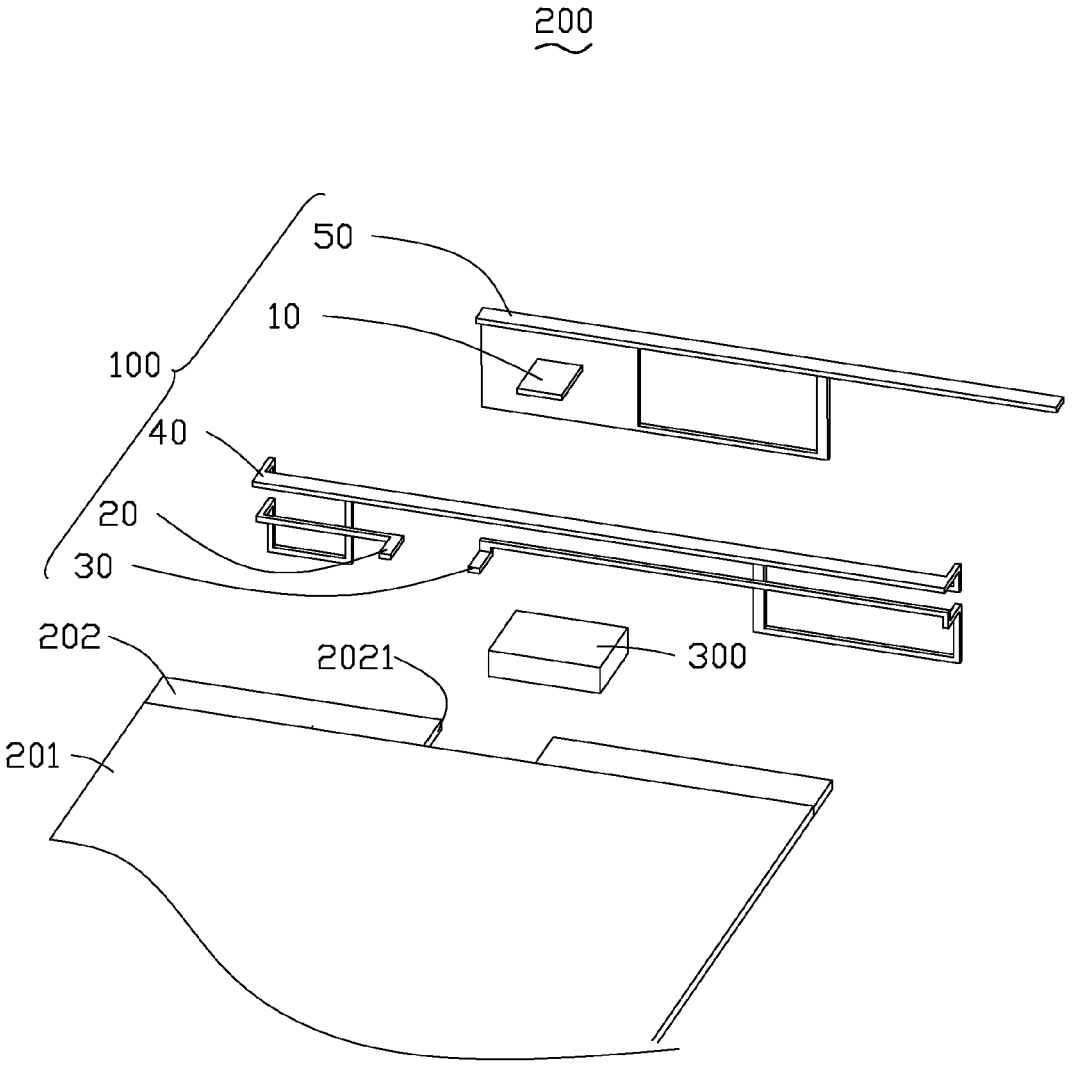
FIG. 1 is an exploded view of one embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "inside" indicates that at least a portion of a region is partially contained within a boundary formed by the object. The term "comprising" when utilized, means "including, but not necessarily limited to"; it specifically indicates open-ended inclusion or membership in the so-described combination, group, series and the like.

FIG. 1 illustrates an exploded view of one embodiment of a wireless communication device 200 employing an antenna structure 100. The antenna structure 100 includes a feeding portion 10, a first grounding portion 20, a second grounding portion 30, a first loop antenna 40, and a second loop antenna 50. The first loop antenna 40 is electronically coupled to the first and second grounding portions 20 and 30, and defined to accept the second loop antenna 50 therein. The second loop antenna 50 is electronically coupled to the feeing portion 10, and is positioned inside and apart from the first loop antenna 40.

The wireless communication device 200 further includes a printed circuit board 201, a dielectric substrate 202 coupled to an end of the printed circuit board 201, and a universal serial bus (USB) connector 300. The dielectric substrate 202 has a cutout 2021 defined in the middle of the dielectric substrate 202. The USB connector 300 can be received in the cutout 2021 (also see FIG. 2).

Figure 2:
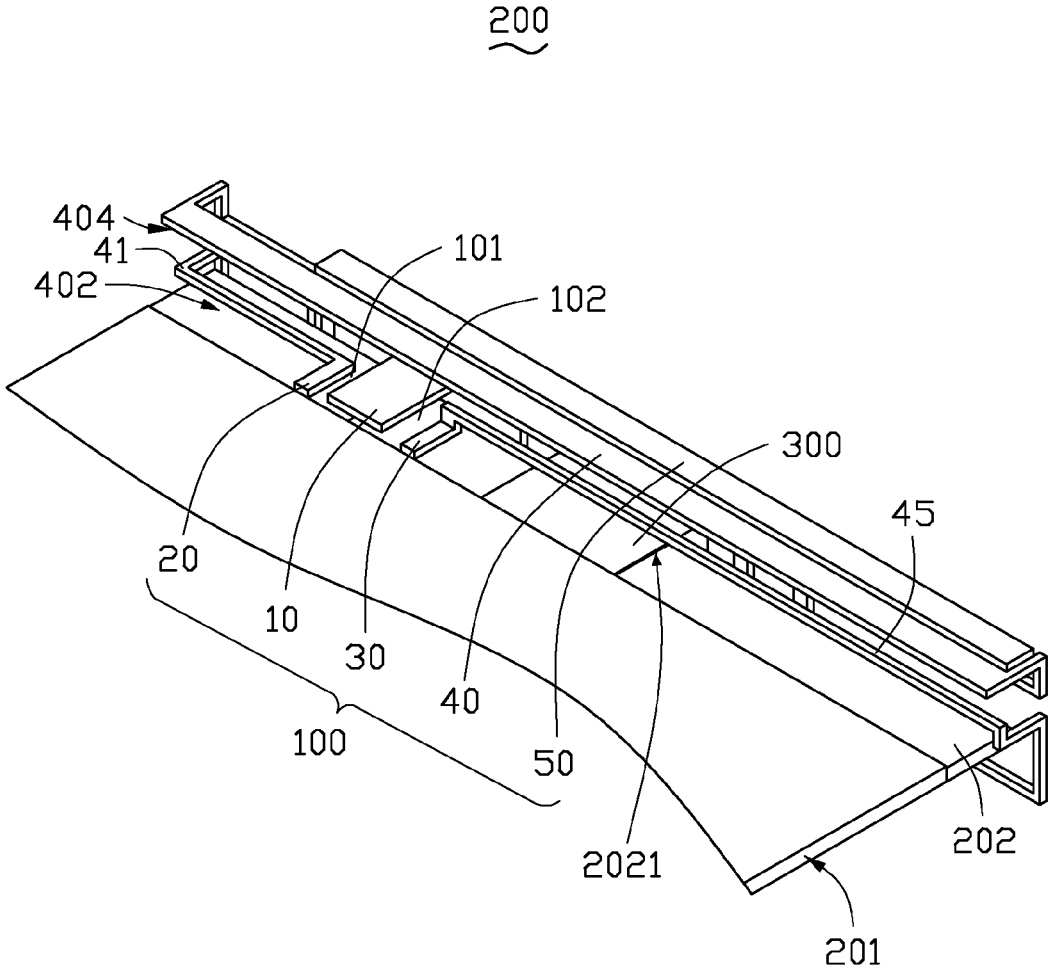
FIG. 2 is an isometric view of the wireless communication device as shown in FIG. 1.

FIG. 2 illustrates an isometric view of the wireless communication device as shown in FIG. 1. The feeding portion 10, the first grounding portion 20, and the second grounding portion 30 are positioned on the dielectric substrate 202 at a same side of the cutout 2021. The feeding portion 10 is electronically coupled to the printed circuit board 201 for feeding current signals, and includes a first side and a second side parallel to the first side. The first grounding portion 20 is positioned adjacent and apart from the first side of the feeding portion 10, and further electronically coupled to the printed circuit board 201 to be coupled to ground. The second grounding portion 30 is position adjacent and apart from the second side of the feeding portion 10, and further electronically coupled to the printed circuit board 201 to be coupled to ground. In one embodiment, the feeding portion 10, the first and second grounding portions 20 and 30 are rectangular strips, and the feeding portion 10 is wider than both the first and second grounding portions 20 and 30. A first slit 101 is defined between the feeding portion 10 and the first grounding portion 20, and a second slit 102 is defined between the feeding portion 10 and the second grounding portion 30.

Figure 3:
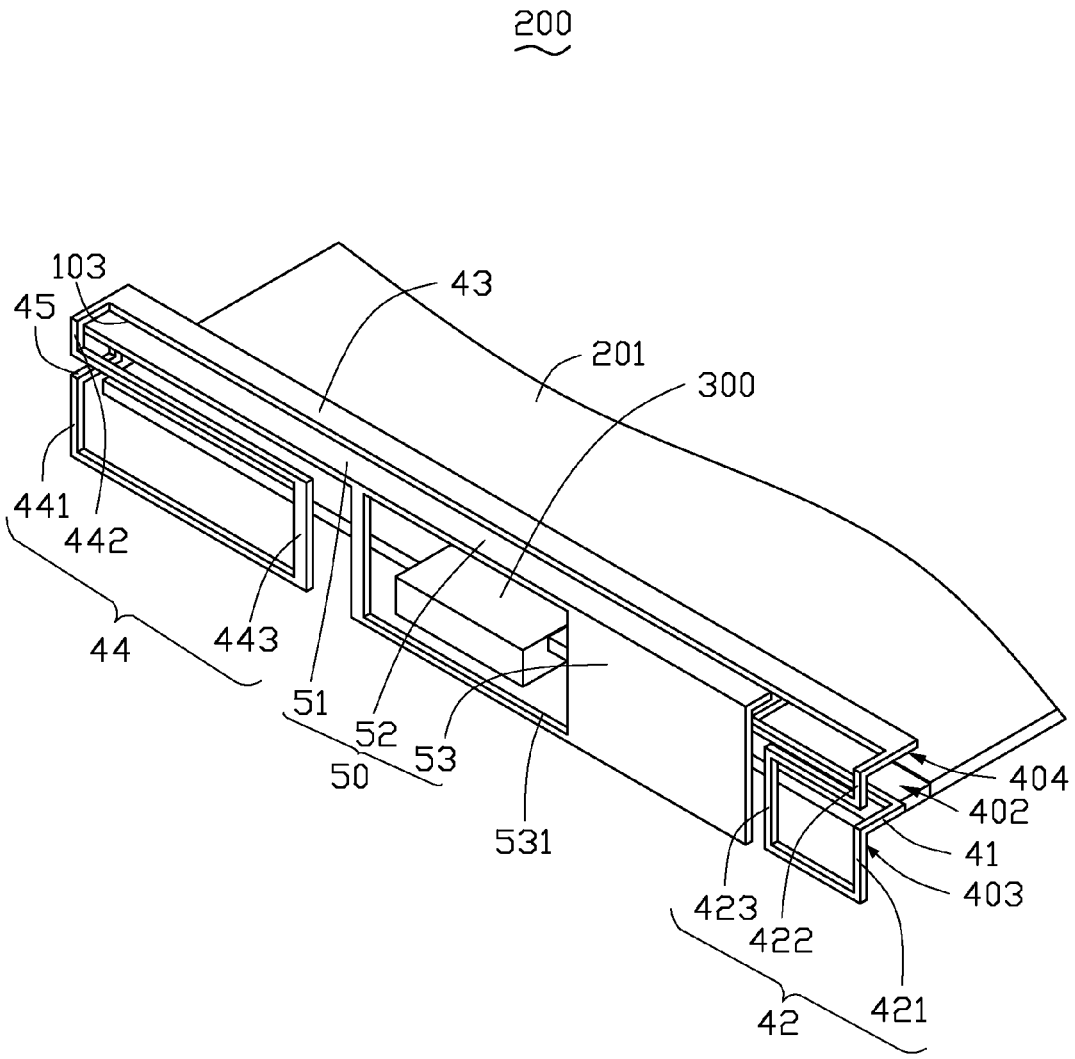
FIG. 3 is similar to FIG. 2, but showing the wireless communication device in another view angle.

FIG. 3 is similar to FIG. 2, but showing the wireless communication device in another view angle. The first loop antenna 40 comprises a first meander strip 41, a second meander strip 42, a third meander strip 43, a fourth meander strip 44, and a fifth meander strip 45, all of which are coupled sequentially. The first meander strip 41 extends from the first grounding portion 20 (see FIG. 2), and is positioned in a first plane 402. The second meander strip 42 is positioned in a second plane 403 that is substantially perpendicular to the first plane 402. The fourth meander strip 44 is positioned in the second plane 403 and facing the second meander strip 42. The third meander strip 43 is coupled between the second and fourth meander strips 42 and 44, and is positioned in a third plane 404 substantially parallel to the first plane 402. The fifth meander strip 45 extends from the second grounding portion 30 away from the first meander strip 41 (also see FIG. 2).

In one embodiment, as illustrated in FIGS. 2-3, the first meander strip 41 is substantially L-shaped. The second meander strip 42 includes a first section 421, a second section 422, and a third section 423 coupled between the first and second sections 421 and 422. The third section 423 is substantially U-shaped. The first section 421 is substantially perpendicularly coupled between the first meander strip 41 and the third section 423. The second section 422 is collinear with the first section 421, and is substantially perpendicularly coupled between the third section 423 and an end of the third meander strip 43. The third meander strip 43 is substantially U-shaped. The fourth meander strip 44 includes a fourth section 441, a fifth section 442, and a sixth section 443 coupled between the fourth and fifth sections 441 and 442. The sixth section 443 is substantially U-shaped. The fourth section 441 is substantially perpendicularly coupled between the fifth meander strip 45 and the sixth section 443. The fifth section 442 is collinear with the fourth section 441, and is substantially perpendicularly coupled between the sixth section 443 and another end of the third meander strip 43. The fifth meander strip 45 is positioned on and apart from a surface of the dielectric substrate 202, when the USB connector 300 is received in the cutout 2021, the fifth meander strip 45 is spaced from the USB connector 300, such that a radiation performance of the antenna structure 100 can be prevented from interference of the USB connector 300.

The first loop antenna 40 defined to accept the second loop antenna 50 is defined by the second, third and fourth meander strips 42, 43 and 44. The second loop antenna 50 includes a first sheet 51, a second sheet 52, and a third sheet 53. The first sheet 51 is positioned between and apart from the third and fourth meander strips 43 and 44. A third slit 103 is defined between the first sheet 51 and the third meander strip 43. The second sheet 52 continuously extends from the first sheet 51 towards the second meander strip 42. The third sheet 53 substantially perpendicularly extends from the second sheet 52, and is positioned between the second and fourth meander strips 42 and 44. The feeding portion 10 is coupled to the third sheet 53. The third sheet 53 has a through hole 531 defined therethrough. The through hole 531 aligns with the USB connector 300, and is configured to expose the USB connector 300.

Figure 4:
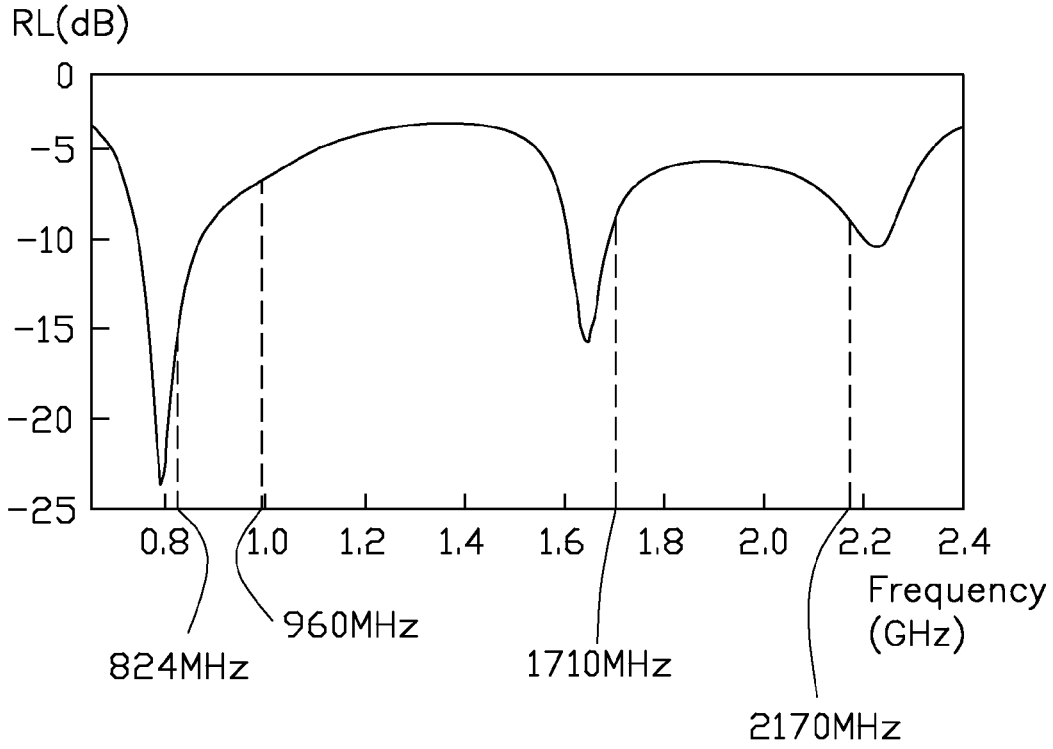
FIG. 4 is a diagram showing return loss ("RL") measurement of the antenna structure of FIG. 1.

FIG. 4 illustrates a diagram showing return loss ("RL") measurement of the antenna structure 100 of FIG. 1. In use, current signals can be fed to the antenna structure 100 through the feeding portion 10. The first loop antenna 40 generates a low resonating mode having a central frequency at about 800 MHz; the first loop antenna 40 resonates with the second loop antenna 50 to cooperatively generates a first high resonating mode having a central frequency at about 1700 MHz; the second loop antenna 50 generates a second high resonating mode having a central frequency at about 2250 MHz. The resonating modes can be adjusted by adjusting the first, second and third slits 101, 102 and 103. As shown in FIG. 4, the RL is lower than −5 dB when the antenna structure 100 operates at the low frequency band from about 824 MHz to about 960 MHz, and a high frequency band from about 1710 MHz to about 2170 MHz.

Figure 5:
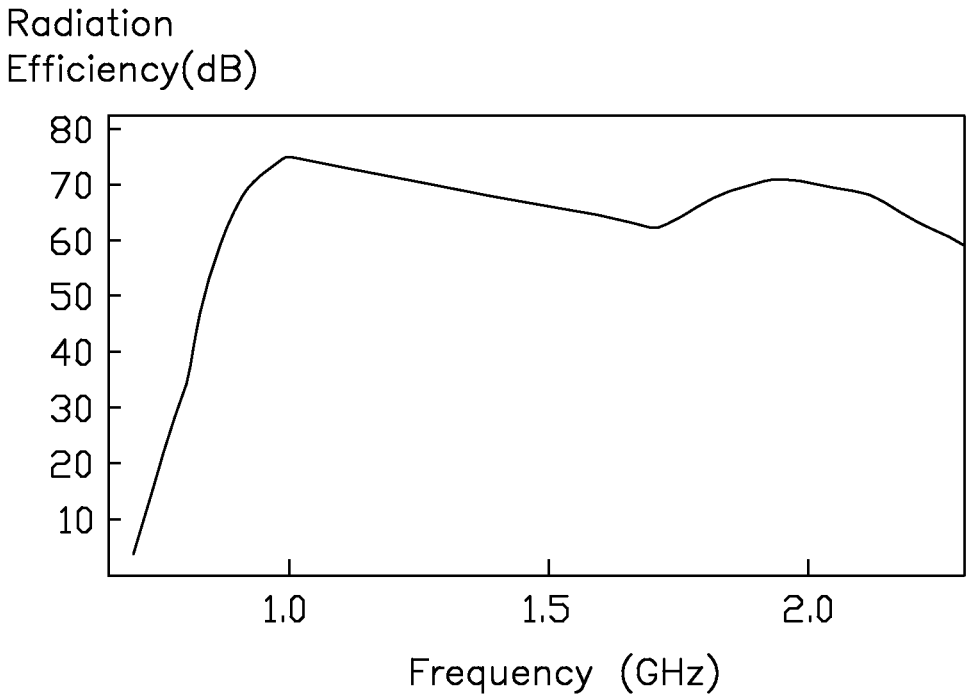
FIG. 5 is a radiation efficiency measurement of the antenna structure of FIG. 1.

FIG. 5 illustrates a radiation efficiency measurement of the antenna structure 100. The radiation efficiency of the antenna structure 100 is greater than 50% at the low frequency band from about 824 MHz to about 960 MHz, and the high frequency band from about 1710 MHz to about 2170 MHz.

Therefore, the antenna structure 100 can operate a low frequency band from about 704 MHz to about 960 MHz, and a high frequency band from about 1710 MHz to about 2170 MHz with an exceptional communication quality.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a feeding portion, the feeding portion comprising a first side and a second side parallel to the first side of the feeding portion;

a first grounding portion positioned adjacent to and spaced part from the first side of the feeding portion;

a second grounding portion positioned adjacent to and spaced part from the second side of the feeding portion; wherein the first grounding portion is positioned at the first side of the feeding portion and the second grounding portion is positioned at the second side of the feeding portion, a first slit is defined between the feeding portion and the first grounding portion, and a second slit is defined between the feeding portion and the second grounding portion;

a first loop antenna defined to receive a second loop antenna position inside and between the first loop antenna and electronically coupled to the first and second grounding portions, wherein the first loop antenna comprises a first meander strip, a second meander strip, a third meander strip, a fourth meander strip, and a fifth meander strip, all of which are coupled together in sequence starting from the first meander strip and ending with the fifth meander strip; the first meander strip extends from the first grounding portion, and is positioned in a first plane; the second meander strip is positioned in a second plane that is substantially perpendicular to the first plane; the fourth meander strip is positioned in the second plane and facing towards the second meander strip; the third meander strip is coupled between the second and fourth meander strips and is positioned in a third plane substantially parallel to the first plane; the fifth meander strip extends from the second grounding portion away from the first meander strip; and the second loop antenna positioned inside and spaced part from the first loop antenna, and further electronically coupled to the feeding portion.

2. The antenna structure of claim 1, wherein the second, third, and fourth meander strips together define the first loop antenna; the second loop antenna comprises a first sheet, a second sheet, and a third sheet; the first sheet is positioned between and spaced part from the third and fourth meander strips; the second sheet continuously extends from the first sheet towards the second meander strip; the third sheet substantially perpendicularly extends from the second sheet; and is positioned between the second and fourth meander strips; the feeding portion is coupled to the third sheet.

3. The antenna structure of claim 1, wherein the first meander strip is substantially L-shaped.

4. The antenna structure of claim 1, wherein the second meander strip comprises a first section, a second section, and a third section, the third section being coupled between the first and second sections; the third section is substantially U-shaped; the first section is substantially perpendicularly coupled between the first meander strip and the third section; the second section is collinear with the first section, and is substantially perpendicularly coupled between the third section and an end of the third meander strip.

5. The antenna structure of claim 4, wherein the fourth meander strip comprises a fourth section, a fifth section, and a sixth section, the sixth section being coupled between the fourth and fifth sections; the sixth section is substantially U-shaped; the fourth section is substantially perpendicularly coupled between the fifth meander strip and the sixth section; the fifth section is collinear with the fourth section, and is substantially perpendicularly coupled between the sixth section and another end of the third meander strip.

6. A wireless communication device comprising:

a printed circuit board; and an antenna structure comprising:

a feeding portion electronically coupled to the printed circuit board the feeding portion comprising a first side and a second side parallel to the first side of the feeding portion;

a first grounding portion positioned adjacent to and spaced apart from the first side of the feeding portion, and further electronically coupled to the printed circuit board;

a second grounding portion positioned adjacent to and spaced apart from the second side of the feeding portion, and further electronically coupled to the printed circuit board; wherein the first grounding portion is positioned at the first side of the feeding portion and the second grounding portion is positioned at the second side of the feeding portion, a first slit is defined between the feeding portion and the first grounding portion, and a second slit is defined between the feeding portion and the second grounding portion;

a first loop antenna defined to receive a second loop antenna position inside and between the first loop antenna and electronically coupled to the first and second grounding portions, wherein the first loop antenna comprises a first meander strip, a second meander strip, a third meander strip, a fourth meander strip, and a fifth meander strip, all of which are coupled together in sequence starting from the first meander strip and ending with the fifth meander strip; the first meander strip extends from the first grounding portion, and is positioned in a first plane; the second meander strip is positioned in a second plane that is substantially perpendicular to the first plane; the fourth meander strip is positioned in the second plane and facing towards the second meander strip; the third meander strip is coupled between the second and fifth meander strips and is positioned in a third plane substantially parallel to the first plane; the fifth meander strip extends from the second grounding portion away from the first meander strip; and the second loop antenna positioned inside and spaced part from the first loop antenna, and further electronically coupled to the feeding portion.

7. The wireless communication device of claim 6, wherein the second, third, and fourth meander strips together define the first loop antenna; the second loop antenna comprises a first sheet, a second sheet, and a third sheet; the first sheet is positioned between and spaced part from the third and fifth meander strips; the second sheet continuously extends from the first sheet towards the second meander strip; the third sheet substantially perpendicularly extends from the second sheet, and is positioned between the second and fifth meander strips; the feeding portion is coupled to the third sheet.

8. The wireless communication device of claim 7, further comprising:

a dielectric substrate positioned at an end of the printed circuit board; and an universal serial bus (USB) connector;

wherein a cutout is defined in the dielectric substrate, wherein the feeding portion, the first grounding portion, and the second grounding portion are all positioned on the dielectric substrate and are located adjacent to a same side of the cutout; the USB connector is received in the cutout.

9. The wireless communication device of claim 8, wherein a through hole is defined through the third sheet, the through hole aligns with the USB connector and exposes the USB connector.

10. The wireless communication device of claim 6, wherein the first meander strip is substantially L-shaped.

11. The wireless communication device of claim 6, wherein the second meander strip comprises a first section, a second section, and a third section, the third section being coupled between the first and second sections; the third section is substantially U-shaped; the first section is substantially perpendicularly coupled between the first meander strip and the third section; the second section is collinear with the first section, and is substantially perpendicularly coupled between the third section and an end of the third meander strip.

12. The wireless communication device of claim 11, wherein the fourth meander strip comprises a fourth section, a fifth section, and a sixth section, the sixth section being coupled between the fourth and fifth sections; the sixth section is substantially U-shaped; the fourth section is substantially perpendicularly coupled between the fifth meander strip and the sixth section; the fifth section is collinear with the fourth section, and is substantially perpendicularly coupled between the sixth section and another end of the third meander strip.

13. A wireless communication device comprising:

a printed circuit board; and an antenna structure comprising:

a feeding portion electronically coupled to the printed circuit board the feeding portion comprising a first side and a second side parallel to the first side of the feeding portion;

a first grounding portion positioned adjacent to and spaced apart from the first side of the feeding portion, and further electronically coupled to the printed circuit board;

a second grounding portion positioned adjacent to and spaced apart from the second side of the feeding portion, and further electronically coupled to the printed circuit board;

a first loop antenna defined to receive a second loop antenna position inside and between the first loop antenna, and electronically coupled to the first and second grounding portions, wherein the first loop antenna comprises a first meander strip, a second meander strip, a third meander strip, a fourth meander strip, and a fifth meander strip, all of which are coupled together in sequence starting from the first meander strip and ending with the fifth meander strip; the first meander strip extends from the first grounding portion, and is positioned in a first plane; the second meander strip is positioned in a second plane that is substantially perpendicular to the first plane; the fourth meander strip is positioned in the second plane and facing toward the second meander strip; the third meander strip is coupled between the second and fifth meander strips and is positioned in a third plane substantially parallel to the first plane; the fifth meander strip extends from the second grounding portion away from the first meander strip; and the second loop antenna positioned inside and spaced apart from the first loop antenna, and further electronically coupled to the feeding portion a dielectric substrate positioned at an end of the printed circuit board; and an universal serial bus (USB) connector;

wherein a cutout is defined in the dielectric substrate, the feeding portion, the first grounding portion and the second grounding portion are positioned on the dielectric substrate and are located adjacent to a same side of the cutout; the USB connector is received in the cutout.

14. The wireless communication device of claim 13, wherein the second, third, and fourth meander strips together define the first loop antenna; the second loop antenna comprises a first sheet, a second sheet, and a third sheet; the first sheet is positioned between and spaced apart from the third and fifth meander strips; the second sheet continuously extends from the first sheet towards the second meander strip; the third sheet substantially perpendicularly extends from the second sheet, and is positioned between the second and fifth meander strips; the feeding portion is coupled to the third sheet.

15. The wireless communication device of claim 14, wherein a through hole is defined in the third sheet, the through hole aligns with the USB connector, and is configured to expose the USB connector.

16. The wireless communication device of claim 13, wherein the first meander strip is substantially L-shaped.

17. The wireless communication device of claim 13, wherein the second meander strip comprises a first section, a second section, and a third section, a third section being coupled between the first and second sections; the third section is substantially U-shaped; the first section is substantially perpendicularly coupled between the first meander strip and the third section; the second section is collinear with the first section, and is substantially perpendicularly coupled between the third section and an end of the third meander strip.

18. The wireless communication device of claim 17, wherein the fourth meander strip comprises a fourth section, a fifth section, and a sixth section, the sixth section being coupled between the fourth and fifth sections; the sixth section is substantially U-shaped; the fourth section is substantially perpendicularly coupled between the fifth meander strip and the sixth section; the fifth section is collinear with the fourth section, and is substantially perpendicularly coupled between the sixth section and another end of the third meander strip.

* * * * *